US005957142A

United States Patent [19]

Karafilis

[11] Patent Number: 5,957,142

[45] Date of Patent: Sep. 28, 1999

[54] APPARATUS FOR HELPING WITH APPLICATION OF EYE MAKE-UP

[76] Inventor: Cindy Ann Karafilis, 1901 Brinson Rd., Apt. P7, Lutz, Fla. 33549

[21] Appl. No.: 09/236,738

[22] Filed: Jan. 25, 1999

[51] Int. Cl.[6] ..... A45D 40/30; A45D 29/00; A42B 1/18; A41D 13/00

[52] U.S. Cl. ..... 132/319; 132/285; 132/216; 132/217; 2/174; 2/9

[58] Field of Search ..... 132/319, 285, 132/217, 216, 150; 2/174, 9

[56] References Cited

U.S. PATENT DOCUMENTS

| | | | |
|---|---|---|---|
| D. 119,329 | 3/1940 | Leyne | 132/319 |
| 1,850,540 | 3/1932 | Erickson . | |
| 1,873,928 | 8/1932 | Bohner | 132/319 |
| 1,907,476 | 5/1933 | Ballard et al. | 132/319 |
| 1,974,825 | 9/1934 | Lovie | 132/319 |
| 2,035,667 | 3/1936 | Payes et al. | 132/150 |
| 2,260,614 | 10/1941 | Freitas | 132/319 |
| 2,611,375 | 9/1952 | Bablon | 132/216 |
| 2,675,004 | 4/1954 | Bablon | 132/216 |
| 3,789,856 | 2/1974 | Bomba | 132/319 |
| 5,016,658 | 5/1991 | Green | 132/216 |
| 5,050,624 | 9/1991 | Kobe et al. | 132/319 |
| 5,052,417 | 10/1991 | Cordova | 132/216 |
| 5,178,170 | 1/1993 | Kassai | 132/319 |
| 5,311,888 | 5/1994 | Leigh | 132/319 |

*Primary Examiner*—John J. Wilson
*Assistant Examiner*—Robyn Doan
*Attorney, Agent, or Firm*—Tarolli, Sundheim, Covell, Tummino & Szabo

[57] ABSTRACT

An apparatus for helping with application of make-up includes a handle having a pair of spaced apart arms, which are connectable with an applicator mask. The applicator mask has an elongated end which is positioned along an individual's eyelid to help with the application of make-up.

17 Claims, 2 Drawing Sheets

APPARATUS FOR HELPING WITH APPLICATION OF EYE MAKE-UP

TECHNICAL FIELD

The present invention relates generally to an apparatus for helping with the application of make-up and, more particularly, to an apparatus for helping with the application of eye make-up.

BACKGROUND OF THE INVENTION

A common concern when applying make-up is inadvertent smudging or smearing of the make-up being applied. With regard to applying mascara, in particular, additional precautions must be taken so that the mascara does not contact the individual's eyes. The application of mascara onto one's eyelashes is further complicated because of the absence of an appropriate backing for the mascara brush to engage. This often results in the mascara clumping on the eyelashes.

Several different devices have been proposed to assist in the application and/or removal of eye make-up. For example, U.S. Pat. No. 1,873,928 discloses a shield that supports the eyelashes during the application of eye make-up. The shield includes a sheet which is curved according to the shape of the base of the eyelashes.

U.S. Pat. No. 2,260,614 discloses an eye shield of a generally hour glass shape and having a pair of opposed concave end edges. The concave edges are used to shield the eyelids during the application of mascara.

U.S. Pat. No. 3,789,856 discloses a shield having a sharp edge portion that is contoured according to the curvature of an eyeball so as to fit around the underside of the eyeball.

U.S. Pat. No. 5,016,658 discloses a make-up shield that includes a pair of opposed concave curved ends that are spaced apart by an elongated narrow handle attached at the center of the curved ends. The curved ends also shield the eyelids when applying eye make-up.

U.S. Pat. No. 5,178,170 discloses a flat elongated shield member also having a pair of opposed concave ends which may be positioned above and below the eye, respectively, during application of eye make-up. The end portions each have a different radius of curvature for the upper and lower eyelids. This patent also discloses an alternative embodiment in which one end of the shield device may be attached to a cylindrical make-up case.

SUMMARY OF THE INVENTION

The present invention is directed to an apparatus for helping with the application of eye make-up. The apparatus includes a handle and a pair of spaced apart arms that extend from the handle. Each of the spaced apart arms terminates in a corresponding end part. The apparatus also includes an applicator mask having a pair of spaced apart connectors which are connectable with the end parts of the arms. Preferably, the applicator mask is formed of a flexible material that is movable relative to the arms, so as to conform the mask substantially to the shape of an individual's eyelid.

BRIEF DESCRIPTION OF THE DRAWINGS

Preferred embodiments of the present invention are illustrated in the accompanying drawings in which.

DESCRIPTION OF PREFERRED EMBODIMENTS

Figure 1:
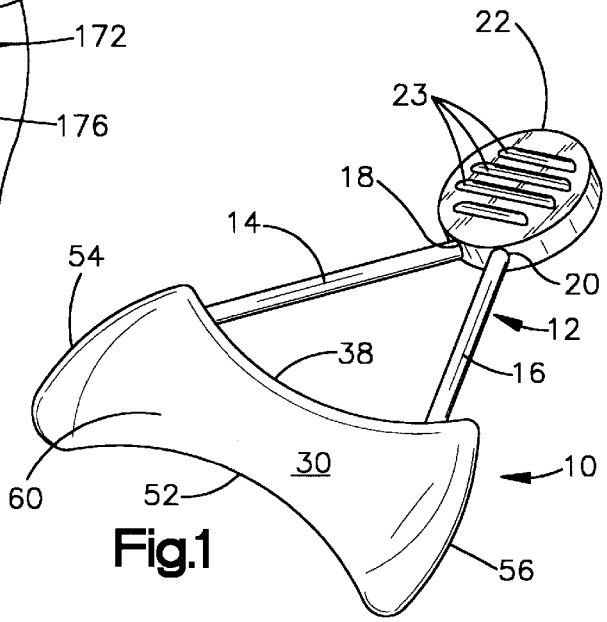
FIG. 1 is a perspective view of an apparatus in accordance with a preferred embodiment of the present invention.
Figure 2:
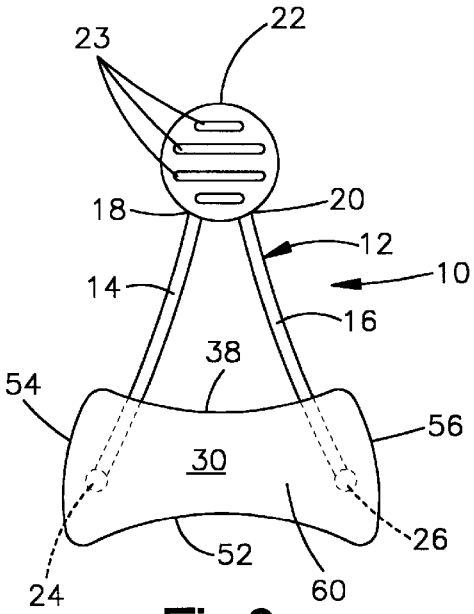
FIG. 2 is a top view of the apparatus of FIG. 1.
Figure 3:
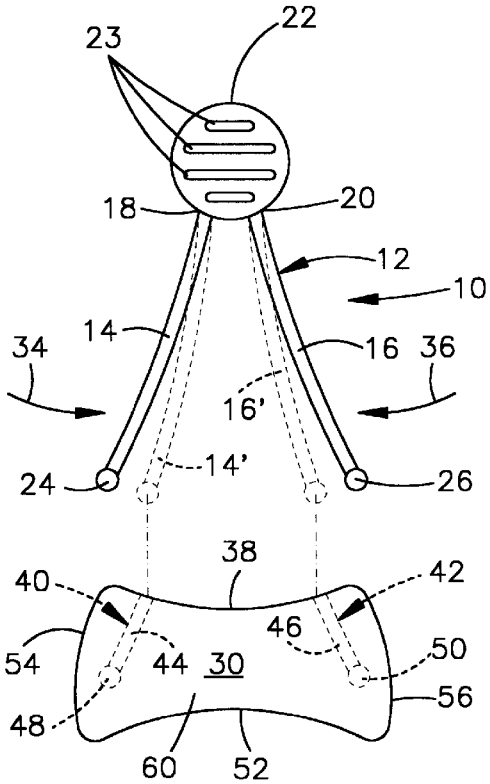
FIG. 3 is an exploded view of the apparatus of FIG. 2.

FIGS. 1–3 illustrate an apparatus 10 in accordance with a preferred embodiment of the present invention. The apparatus 10 includes a handle portion 12 having a pair of spaced apart and elongated arm portions 14 and 16. In this embodiment, a first end 18 and 20 of each respective arm 14 and 16 is connected to a grip member 22.

The grip member 22 preferably includes projections 23, suitably in the form of ridges or grooves, which conveniently may be gripped by a person using the apparatus 10. The projections 23 reduce the likelihood of the user dropping the apparatus 10. The grip member 22 also may be covered with a common non-slip surface, such as rubber, sand paper, or another appropriate material which may reduce the likelihood of the apparatus 10 sliding out of one's grip. In addition or in the alternative, the grip member 22 may have a curved surface to receive a thumb or finger. The particular shape for the grip member 22 is a matter of design choice, as any shape or configuration should suffice.

The arms 14 and 16 extend a predetermined distance from the grip member 22 and terminate in end portions 24 and 26. The second end 24 and 26 of each respective arm 14 and 16 is mounted to an applicator mask or shield 30. In this embodiment the ends 24 and 26 are formed of bulbous spherical portions, suitably integral with the arms 14 and 16. Of course, other shapes, such as conical, cubical, polygonal, hemispherical, etc., may be used for the bulbous end portions.

Preferably, the ends 24 and 26 are spaced apart a greater distance from each other than the other ends 18 and 20, which are attached to the grip portion 22. While, as shown in the preferred embodiment of FIGS. 1–3, the arms 14 and 16 together with the grip member 22 form a substantially V-shaped handle 12, with the grip member 22 at the vertex, it will be appreciated that other spatial relationships for the arms and other handle configurations may be used. For example, the arms 14 and 16 may be oriented substantially parallel or the grip member 22 may be formed of a rectangular sheet from which the arms 14 and 16 extend.

The arms 14 and 16, preferably are formed of a generally rigid, yet resilient material. The arms 14 and 16 may be formed of a metal, plastic or other appropriate material.

Referring to FIG. 3, the arms 14 and 16 preferably formed of a resilient material so that they are movable toward each other, as indicated at arrows 34 and 36. This enables the arms 14 and 16 to be moved inwardly toward one another to a position indicated by dashed lines at 14' and 16'. Upon releasing arms 14 and 16, they return substantially to their original positions, as indicated in solid lines. This facilitates the attachment of the arms 14 and 16 to the applicator mask 30.

It also may be desirable to provide for some inelastic deformation of the handle 12. Specifically, the grip member 22 may be bent to a preferred position relative to the arms 14 and 16. In this way, the user can customize the configuration of the handle 12 to facilitate use of the apparatus 10.

The applicator mask 30 has a first end 38 that includes a pair of connector parts, such as spaced apart receptacles 40 and 42. The receptacles 40 and 42 are dimensioned and configured to connect with the pair of corresponding ends 24 and 26. Accordingly, with the arms at positions 14' and 16', as illustrated in FIG. 3, the ends 24 and 26 may be aligned with the entrance of the receptacles 40 and 42 to facilitate their insertion.

In the embodiment of FIGS. 1–3, the receptacles 40 and 42 are formed of elongated channels 44 and 46 extending a predetermined distance from the first end 38 and terminating in receiving ports 48 and 50. The receiving ports 48 and 50 are configured according to the dimensions and configurations of the bulbous ends 24 and 26. The receiving ports 48 and 50 have a greater diameter than the channel portions 44 and 46.

The ends 24 and 26 are inserted through the channels 44 and 46 and into the receiving ports 48 and 50, respectively. The attachment is facilitated because the applicator mask 30 preferably is formed of a generally soft, flexible material, such as, for example, rubber, silicon, a foam material, a sponge, or other suitable material. The channels 44 and 46, thus, are able to stretch and accommodate the larger diameter at the ends 24 and 26 of the respective arms 14 and 16. Preferably, the length of the arms 14 and 16 extending between the ends 24, 26 and the grip member 22 suitably has a diameter which approximates the diameter of the channels 44 and 46. This advantageously provides for a substantially tight, yet removable connection between the handle 12 and the applicator mask 30.

While the channels 44, 46 and arms 14, 16 are shown and described generally as having circular cross sections, it will be appreciated that other cross sectional shapes, e.g., polygonal or C-shaped, also may be used.

The applicator mask 30 further includes a second elongated end portion 52 spaced from and opposite the first end portion 38. Preferably, the second end portion 52 is concave and substantially conforms to the shape of the base of the eyelids from where the eyelashes extend. A pair of opposed and spaced apart side edges 54 and 56 extend between the elongated end portions 38 and 52. The side edges 54 and 56 typically, although not necessarily, are shorter in length than the end portions 38 and 52.

Figure 5:
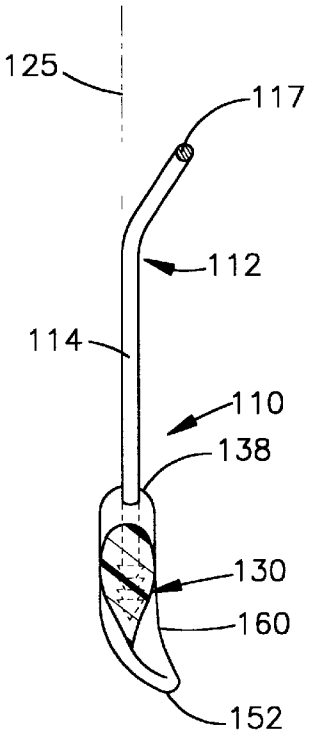
FIG. 5 is a sectional view taken along line 5—5 of FIG. 4.

The applicator mask 30 preferably has a cross-sectional thickness which tapers from a first thickness adjacent the first end 38 to a second thickness, which is less than the first, at the second end 52. Alternatively, the thickness of the mask 30 along the second end 52 could be uniform, although preferably less than the thickness of the mask adjacent to end 38. This provides a desired sharp edge to facilitate smooth and flowing brush strokes along the entire length of eye lashes and onto the exposed surface 60 of the applicator mask 30, suitably with a mascara brush. It will be appreciated that the make-up may be brushed onto either side surface of the mask 30. The cross-sectional view of the applicator mask 30 may be as shown in FIG. 5.

Figure 4:
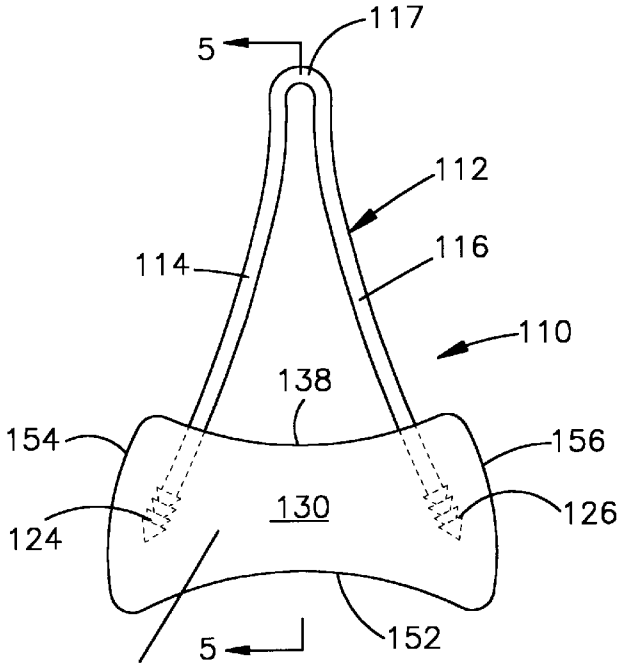
FIG. 4 is a top view of an apparatus in accordance with an alternative preferred embodiment of the present invention.

FIG. 4 illustrates an alternative preferred embodiment of an apparatus 110 of the present invention in which like reference numerals, increased by adding 100, are used to illustrate corresponding parts previously described with respect to the embodiment of FIGS. 1–3.

Figure 6:
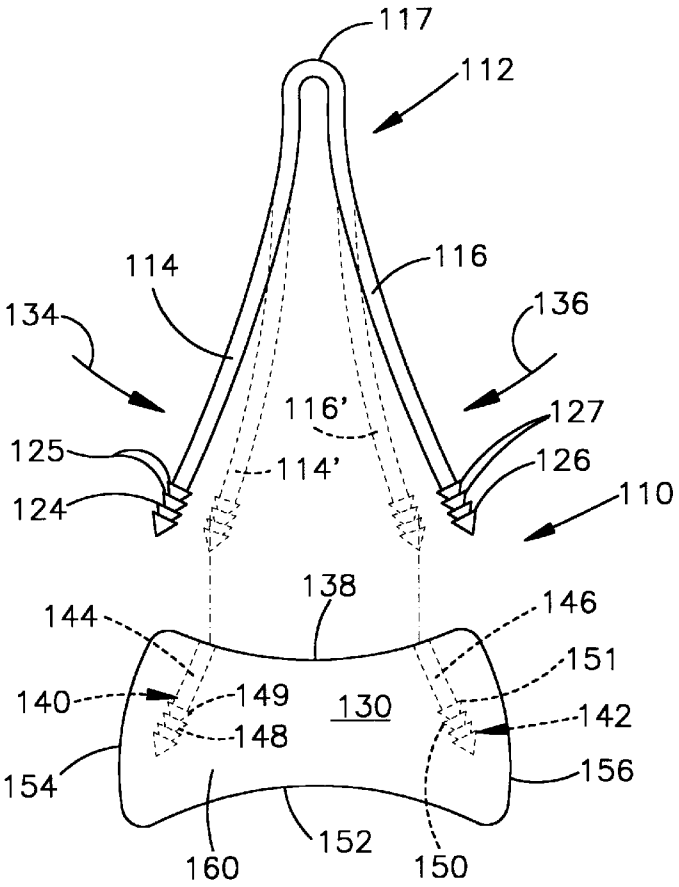
FIG. 6 is an exploded view of the apparatus of FIG. 4.

In this embodiment, the apparatus 110 includes a handle 112 having a pair of spaced apart arms 114 and 116 that extend outwardly from an intermediate bend portion 117. The arms 114 and 116 terminate in spaced apart end portions 124 and 126 to form a generally V-shaped handle portion 112, as illustrated in FIGS. 4 and 6. The bend portion 117, which is located at the vertex of the handle 112, conveniently forms a grip portion which may be gripped by a user.

The arms 114 and 116 may be formed of substantially identical materials to those described above with the embodiment of FIGS. 1–3. The arms 114 and 116 should be sufficiently resilient to permit flexing of the arms toward each other in the direction of arrows 134 and 136. Accordingly, the arms 114 and 116 are easily moved to a desired position, illustrated as dashed lines 114' and 116' in FIG. 6, to facilitate connection with an applicator mask 130.

At least part of the handle 112, suitably the gripping portion of the handle, is bendable. In particular, the bend portion 117 may be bent to a desired angle relative to a plane 125 defined by the end portions 124 and 126 of the arms 114 and 116, as shown in FIG. 5. Accordingly, the user may customize the relative position of the gripping portion of the handle 112.

In this embodiment, the end portions 124 and 126 are formed of generally bulbous end parts that include at least one, and preferably a plurality of adjacent, semi-conical portions aligned axially along each arm 114 and 116. The part of each semi-conical portion of the ends 124 and 126 having the greatest diameter defines a detent surface 125 and 127.

As shown in FIGS. 4–6, the end portions 124 and 126 of the handle 112 are connectable with an associated applicator mask 130. The end portions 124 and 126 are mountable with connector parts of the mask 130, which are illustrated as receptacles 140 and 142. The receptacles 140 and 142 are formed in a first elongated end 138 of the mask 130.

The receptacles 140 and 142 are formed of elongated channels 144 and 146 which extend from the proximal end 138 of the applicator mask 130. The channels 144 and 146 open into receiving ports 148 and 150 dimensioned and configured according to the dimensions and configurations of ends 124 and 126. The juncture between the receiving ports 148 and 150 and the respective channels 144 and 146 define a shoulder part 149 and 151, which may engage a corresponding detent surface 125 and 127 of the respective ends 124 and 126 positioned within the receiving ports 148 and 150, respectively.

The generally conical shaped ends 124 and 126 provide for easy insertion through the channels and into the receiving ports 148 and 150 of the receptacles 140 and 142. Preferably, the outermost diameter of ends 124 and 126 is slightly greater than the diameter of the channels 144 and 146, respectively. Because the applicator mask 130 preferably is formed of a flexible material, as described above, the channels 144 and 146 flex during insertion of the ends 124 and 126 through the channels. The ends 124 and 126 are inserted into the respective receiving ports 148 and 150 and a detent surface 125 and 127 of each of the ends 124 and 126 engage corresponding shoulder parts 149 and 151, thereby resisting removal of ends from the applicator mask.

Preferably, the applicator mask 130 is formed of substantially identical materials to those described above. The soft, flexible material not only conforms to the shape of the individual's eye, it also provides a softer more comfortable feel to the user.

As shown in FIG. 5, the applicator mask 130 preferably has a cross-section that tapers to a generally sharp edge adjacent the second elongated end 152, which is opposite the first end 138. The end 152 may be positioned along the base of an individual's eyelid during application of make-up. The sharper and contoured end portion 152 advantageously enables a smoother brush stroke over the eyelash and onto the surface 160 of the applicator mask 130. The second end 152 also is concave according to the shape of an individual's eyelid.

Referring to FIG. 6, the spaced apart ends 124 and 126 of each of the arms 114 and 116 are attached to the applicator mask 130 adjacent opposed side edges 154 and 156 of the mask. This provides for flexible movement of at least part of the applicator mask 130 intermediate the receptacles 140 and 142 upon engaging an individual's eyelid. Accordingly, at least part of the mask 130 flexes or bends relative to the arms 114 and 116 to conform the mask substantially to the contour of the eyelid. Significantly, this enables a single design of applicator mask to be used for virtually any shape eyelid and eyeball.

Figure 7:
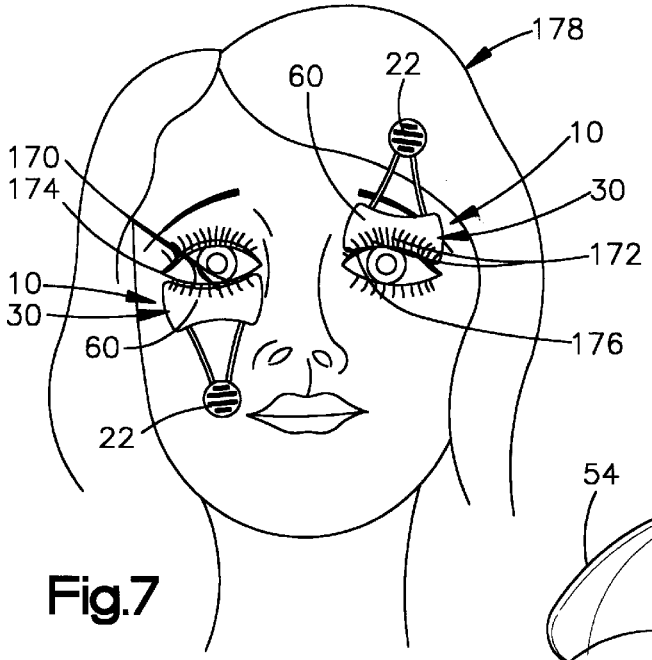
FIG. 7 illustrates use of an apparatus in accordance with a preferred embodiment of the present invention.

Each of the preferred embodiments of apparatuses 10 and 110 described above may be used in substantially identical ways. For purposes of brevity, FIG. 7 illustrates the use of the apparatus 10 of FIGS. 1–3. The apparatus 10 may be used to help with the application or removal of make-up, such as, for example, mascara, eyeliner or eyeshadow.

In order to use the apparatus 10 in the application of mascara, for example, the individual first closes their eye and positions the distal end 52 of the applicator mask 30 above or below the eyelash 170, 172 based on which eyelash the make-up is being applied. The end 52 engages the eyelid 174, 176 just below or above the lashes 170 receiving the mascara. The apparatus 10 may be held at the grip 22 by the left or right hand, depending upon the individual's preference.

The individual 178 simply applies the mascara by rubbing a mascara brush (not shown) in a conventional manner against both the lashes 170, 172 and the appropriate surface 60 of the applicator mask 30. The surface 60 of the applicator mask 30 advantageously provides a desirable surface 60 against which the lashes 170, 172 may be brushed. This helps to reduces clumping due to excess mascara as well as facilitates in the separation of the lashes 170, 172. In addition, the mask 30 provides a shield to inhibit smearing or smudging of the mascara. Thus, an individual is able to create more professional looking and beautiful eyelashes.

Excess mascara collects on the surface 60 of the flexible applicator mask 30 instead of clumping or smearing onto the eyelid. The excess mascara may simply be rinsed or wiped off the applicator mask 30. Depending upon the material used for the applicator mask 30, there might be a build-up of make-up on the surface 60 of the mask after a significant number of uses. If this occurs, the old applicator mask 30 may simply be removed from the handle part 12 and discarded. A fresh applicator mask 30 is then attached to the handle 112, as described above, so that the user may continue to benefit from beautiful, long eyelashes.

It will be understood and appreciated that the bulbous or conical ends may be used with either embodiment of the present invention. It further will be appreciated that other configurations of end portions may be used without departing with the spirit and scope of the present invention. For example, a moveable latch mechanism, various types of friction fittings or other couplings may be used. In addition, rather than the removable couplings described above, the applicator mask also might be fixed to the handle portion and, further, may be integrally formed with the handle, such as by injection molding.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for helping with application of makeup, said apparatus comprising:

a substantially rigid handle member including a pair of substantially rigid spaced apart arms extending from an end of said handle member; and an applicator mask formed of flexible material having a first end, each of said spaced apart arms being connected with said applicator mask, said applicator mask having a second end spaced from and opposite said first end, whereby, upon the flexible material of the applicator mask engaging an eyelid, the flexible material is moveable relative to the arms to substantially conform the applicator mask to the contour of the eyelid.

2. An apparatus as set forth in claim 1 wherein said second end of said applicator mask has a cross-sectional thickness which tapers from a first thickness at a location spaced from said second end to a second thickness extending along said second end, said second thickness being less than said first thickness.

3. An apparatus as set forth in claim 1 wherein each of said spaced apart arms has a first cross-sectional thickness adjacent to the end of said handle member, each of the corresponding end parts of said spaced apart arms having a second cross-sectional thickness which is greater than the first cross-sectional thickness of the respective said arm adjacent to the end of said handle member.

4. An apparatus as set forth in claim 3 wherein each of said end parts of said spaced apart arms further includes a male part configured for attachment with a corresponding one of said connectors of said applicator mask.

5. An apparatus as set forth in claim 1 wherein each of said connectors further comprises a receptacle formed in said first end of said applicator mask.

6. An apparatus as set forth in claim 5 wherein each of said end parts of said spaced apart arms is formed of a generally bulbous, male end part mountable within a corresponding one of said receptacles.

7. An apparatus as set forth in claim 6 wherein each of said receptacles further comprises a channel of a first diameter formed in said first end of said applicator mask and terminating in a receiving port at a location intermediate said first and second ends of said applicator mask, each of said receiving ports being configured to receive the corresponding said male end part of said spaced apart arms.

8. An apparatus as set forth in claim 7 wherein said applicator mask is formed of a flexible material so as to facilitate insertion and removal of said male end parts into and from, respectively, the corresponding said receptacles of said applicator mask.

9. An apparatus as set forth in claim 5 wherein said end parts of said spaced apart arms are removable from said receptacles of said applicator mask.

10. An apparatus for helping with application of eye makeup, said apparatus comprising:

an applicator mask formed of a substantially flexible material, said mask having a pair of spaced apart connectors adjacent a first elongated end portion, with a second elongated end portion spaced from and opposite the first end portion; and a handle part having generally rigid and spaced apart arms which are connected with said connectors, whereby the applicator mask located between the spaced apart arms is moveable relative to the spaced apart arms to conform the applicator mask substantially to the contour of an individual's eyelid.

11. An apparatus as set forth in claim 10 wherein said applicator mask has a first thickness at said first elongated end portion, said applicator mask having a second thickness along said second elongated end portion which is less than said first thickness.

12. An apparatus as set forth in claim 10 wherein each of said connectors further comprises a receptacle formed in said first end portion of said applicator mask.

13. An apparatus as set forth in claim 12 wherein each of said arms of said handle part includes a male end part which is matingly received in one of said receptacles of said applicator mask, said male parts of said arms being removable from the respective receptacles.

14. An apparatus as set forth in claim 13 wherein each of said male end parts is substantially bulbous and configured according to the dimensions and configuration of the corresponding one of said receptacles.

15. An apparatus as set forth in claim 13 wherein said arms converge toward each other to operatively connect at a location distal said mask to form a gripping portion.

16. An apparatus as set forth in claim 15 wherein each of said arms adjacent said gripping portion has a first cross-sectional thickness, each of said male end parts having a second cross-sectional thickness which is greater than the first cross-sectional thickness of the corresponding said arms adjacent to said gripping portion.

17. An apparatus as set forth in claim 10 wherein each of said spaced apart arms terminates in a generally bulbous end part which is received within a corresponding one of said connectors.

* * * * *